US005409203A

United States Patent [19]

Okamoto et al.

[11] Patent Number: 5,409,203

[45] Date of Patent: Apr. 25, 1995

[54] COPYING MACHINE

[75] Inventors: Yuji Okamoto; Manabu Matsumoto, both of Nara, Japan

[73] Assignee: Sharp Kabushiki Kaisha, Osaka, Japan

[21] Appl. No.: 986,603

[22] Filed: Dec. 7, 1992

[30] Foreign Application Priority Data

Dec. 25, 1991 [JP] Japan ..... 3-343479

[51] Int. Cl.[6] ..... B65H 5/22

[52] U.S. Cl. ..... 271/3.1; 271/7

[58] Field of Search ..... 271/3, 3.1, 4, 5, 6, 271/7

[56] References Cited

U.S. PATENT DOCUMENTS 4,078,787 3/1978 Berlew et al. .

4,384,782 5/1983 Acquaviva ..... 271/212 X 4,413,901 11/1983 Kollar ..... 271/212 X 5,084,741 1/1992 Takemura et al. ..... 271/3.1 X 5,183,240 2/1993 Morooka et al. ..... 271/3.1

FOREIGN PATENT DOCUMENTS 0022680 1/1981 European Pat. Off. .

*Primary Examiner*—David H. Bollinger

*Attorney, Agent, or Firm*—Birch, Stewart, Kolasch & Birch

[57] ABSTRACT

A time required for a copying operation is shortened in making duplex copies from simplex documents. In a copying machine provided with a recirculating document feeder for feeding documents one by one from a document container to an exposure region and returning the exposed documents to the document container, when the documents are circulated prior to the copying operation so as to count the number thereof, the copying operation is started immediately in the case where the number of the documents is detected before a first document passes the exposure region.

4 Claims, 10 Drawing Sheets

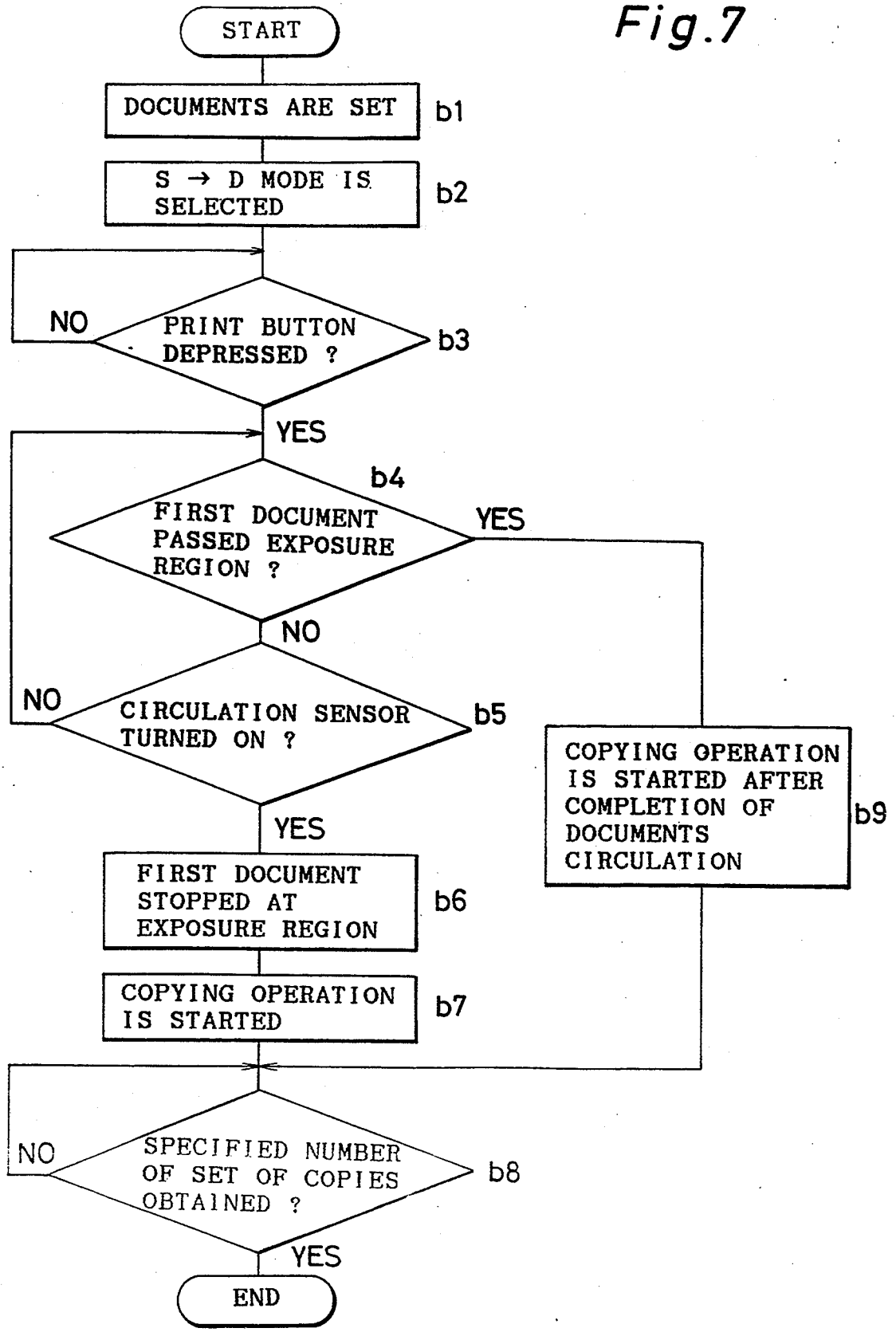
Fig.7
START
DOCUMENTS ARE SET
b1
S → D MODE IS SELECTED
b2
PRINT BUTTON DEPRESSED ?
b3
NO
YES
FIRST DOCUMENT PASSED EXPOSURE REGION ?
b4
YES
NO
CIRCULATION SENSOR TURNED ON ?
b5
NO
YES
FIRST DOCUMENT STOPPED AT EXPOSURE REGION
b6
COPYING OPERATION IS STARTED
b7
COPYING OPERATION IS STARTED AFTER COMPLETION OF DOCUMENTS CIRCULATION
b9
SPECIFIED NUMBER OF SET OF COPIES OBTAINED ?
b8
NO
YES
END

BEST AVAILABLE COPY

COPYING MACHINE

BACKGROUND OF THE INVENTION

Field of the Invention

This invention relates to a copying machine provided with a recirculating document feeder which is used preferably when a plurality of sets of copies are made from a plurality of documents.

Description of Related Art

In a copying machine, in order to save an operator's labor, there has been conventionally used a recirculating document feeder (referred to as an RDH) for feeding documents one by one from a document container to an exposure region, and returning the documents having been subjected to an exposure operation to the document container. In the copying machine provided with the RDH, when duplex copies are made from a plurality of simplex documents which are fed one by one from the last document, a copying method differs depending upon whether the number of documents is odd or even. More specifically, when the number of the documents is odd, a copy sheet copying an image of the last document on one face thereof is discharged without having an image copied on the other face, and images of the remaining documents are sequentially copied onto both faces of the successively fed copy sheets. When the number of the documents is even, the images of the documents are sequentially copied onto both faces of the successively fed copy sheets.

Accordingly, it is necessary to know the number of documents before copying the documents. In the case of a relatively small number of documents, it is not very cumbersome for the operator to count the documents. However, in the case of a large number of documents, a count error is liable to occur and it takes labor and time to count the documents. In view of this, an arrangement is made such that the number of the documents is counted by feeding the documents idly prior to the copying operation, and that the copying operation is started after the number of the documents is determined. In this way, the operator's labor can be saved at the time of copying.

In the prior art described above, a set of documents are required to be idly circulated in order to count the number of documents before the copying operation is started. This presents a problem because it takes a long time to make copies from the documents.

Further in an apparatus disclosed in U.S. Pat. No. 4,078,787 copies are made by the number the operator has set without circulating the document to count the number of the documents using the RDH when only one document is fed to the RDH. However, when a plurality of documents are fed, the documents are idly circulated to count the number thereof without fail. Accordingly, a time required to make copies cannot be shortened.

SUMMARY OF THE INVENTION

It is an object of the invention to provide a copying machine provided with a recirculating document feeder capable of shortening a time required to make copies by reducing the number of document recirculations.

The invention presents a copying machine provided with a recirculating document feeder for feeding documents one by one from a document container to an exposure region and returning the exposed documents to the document container, when the documents are circulated prior to the copying operation so as to count the number thereof, the copying operation is started immediately in the case where the number of the documents is detected before a first document passes the exposure region.

With the copying machine thus constructed, when the documents are circulated to count the number thereof prior to the copying operation using the recirculating document feeder, the copying operation is started immediately in the case where the number of the documents is detected before the first document passes the exposure region. In other words, there are cases where all the documents have been fed from the document container before the first document passes the exposure region when the transport path between the document container and the exposure region is relatively long or when a relatively small number of documents are set in the document container. At the time when the feed of the documents is completed, the number of the documents can be detected by counting how many times the document feeding operation has been executed, and the first document can be copied since the first document has not yet passed the exposure region.

Thus, according to the invention, the copying operation is started immediately upon detecting the number of the documents without circulating all the documents in the case where a relatively small number of documents are set. Accordingly, the circulation of the documents to count the number thereof can be omitted and thereby the time required to make copies can be shortened.

The invention also presents a copying machine provided with a recirculating document feeder comprising:

means for containing a plurality of documents therein in a stacked state;

means for separating and feeding the documents one by one from the containing means;

means for transporting the documents from the feeding means to an exposure region:

means for returning the documents from the exposure region to the containing means:

means for counting the number of the documents in accordance with an output from first document detecting means provided at a downstream side of the feeding means with respect to a transport direction:

means provided in association with the containing means for detecting that the last one of the plurality of documents contained in the containing means has been fed: and second detecting means provided in the vicinity of the exposure region for detecting whether the documents have reached the exposure region; the copying machine further comprising means, when the documents are circulated, for to counting the number of the documents prior to a copying operation in accordance with outputs from the circulation detecting means and the second document detecting means, controllably completing a counting operation of the counting means upon detecting the circulation of all the documents, and starting the copying operation immediately at this time in the case where it is detected that the first document has not yet reached the exposure region.

The invention is also characterized in that the documents are circulated to count the number thereof in the case where duplex copies are made from a plurality of simplex documents and the feed of the documents is started from the last one.

The invention is further characterized in that a plurality of simplex documents are contained in a state where image faces thereof are faced downward, the feeding means feeds the documents from the uppermost one, and the returning means returns the document to a position below the bottommost one of the stacked documents in the recirculating document feeder.

The invention is furthermore characterized in that a plurality of simplex documents are contained in a state where image bearing faces thereof are faced upward, the feeding means feeds the documents from the bottommost one, and the returning means returns the document to a position above the uppermost one of the stacked documents in the recirculating document feeder.

BRIEF DESCRIPTION OF THE DRAWINGS

Other and further objects, features, and advantages of the invention will be more explicit from the following detailed description taken with reference to the drawings wherein:

FIG. 7 is a schematic side view showing an operation of the document feeder 102 shown in FIG. 6;

DETAILED DESCRIPTION OF PREFERRED EMBODIMENTS

Figure 1:
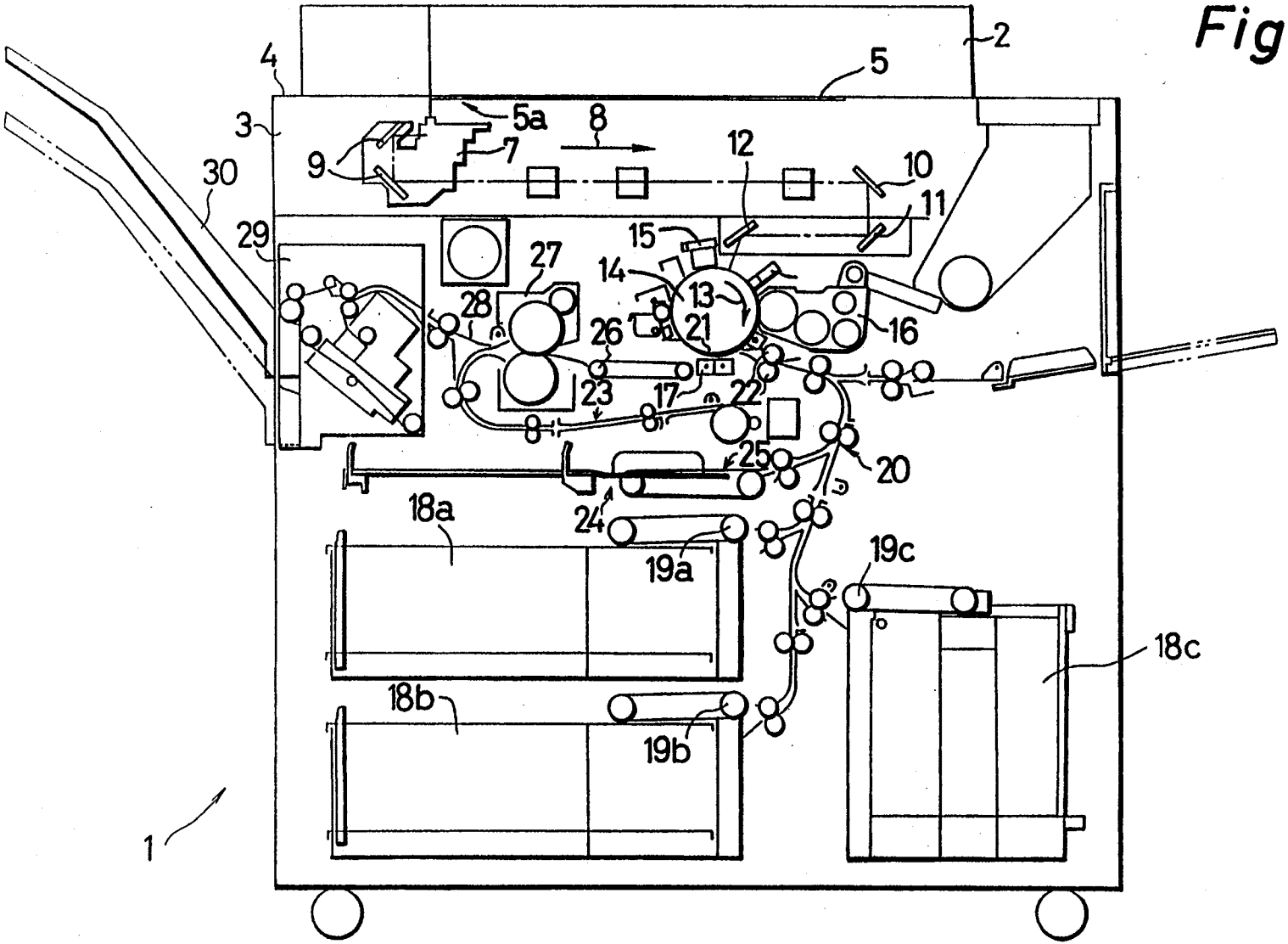
FIG. 1 is a sectional view showing a schematic construction of a copying machine 1 as a first embodiment of the invention.

Now referring to the drawings, preferred embodiments of the invention are described below.

Figure 2:
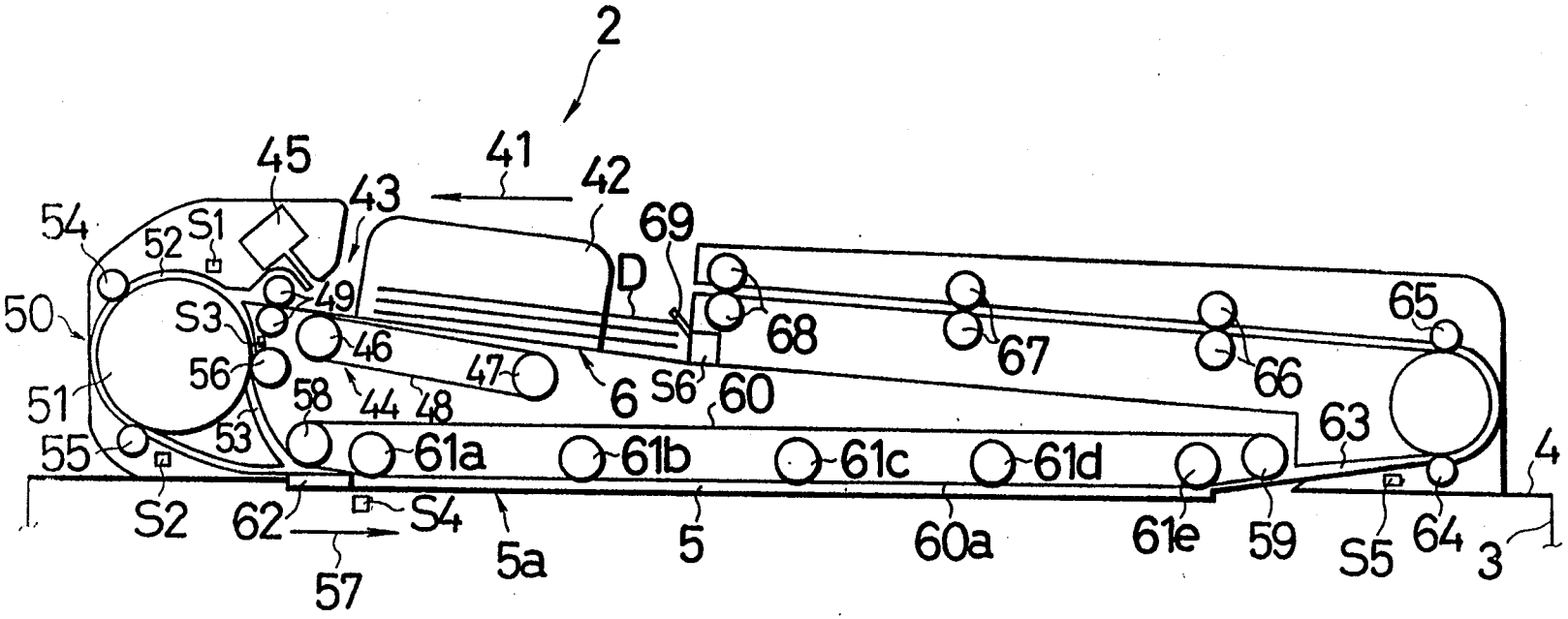
FIG. 2 is a sectional view showing a schematic construction of a recirculating document feeder 2 carried by the copying machine 1 shown in FIG. 1.

FIG. 1 is a sectional view showing a schematic construction of a copying machine 1 as a first embodiment of the invention, and FIG. 2 is a sectional view showing a schematic construction of a recirculating document feeder 2 (hereinafter also referred to as a document feeder) carried by the copying machine 1.

On a top surface 4 of a frame of a copying machine main body 3 is provided a transparent plate 5 made of hard glass or like material. The transparent plate 5 serves as a document reading plane. The document feeder 2 is provided above the transparent plate 5, and is mounted on the top surface 4 angularly displaceable about an unillustrated rotatable shaft. In the case where the documents are not fed by means of the document feeder 2 (e.g., in the case where the document is a book or the like), the document feeder 2 is angularly displaced to open the transparent plate 5, and a document such as a book is placed face downward on the transparent plate 5. The copying operation is executed in this state.

Generally, as shown in FIGS. 1 and 2, the document feeder 2 is placed so as to cover the transparent plate 5, and feeds sheet-like documents D placed and stacked in a document container 6 one by one automatically to a reading station **5*a* which is an exposure region, thereby presenting a document image. The presented document image is optically scanned by an optical reading means provided in the copying machine 1, and thereby a reading/exposing operation for the document image is executed. The documents D having an image thereof read are returned to the document container 6. The circulatory feeding of documents as described above is sequentially carried out for the documents D stacked in the document container 6**, and is conducted a plurality of times according to the number of necessary sets of copies. In this way, document images are copied onto only one face of recording sheets P (simplex copying) or only both faces thereof (duplex copying).

As described above, the reading/exposing operation is executed to the document images presented at the reading station **5*a* by the optical reading means. In the optical reading means, a movable unit 7 including a light source such as a halogen lamp and a plurality of reflecting mirrors 9 moves reciprocally relative to the reading station 5*a* along a horizontal direction 8, and projects the light onto the presented document. The light reflected by the document is transmitted through the reflecting mirrors 10, 11, and 12 and is imaged on a photosensitive member 14 in the form of a right cylinder which is drivingly rotated in an arrow direction 13**.

The surface of the photosensitive member 14 is charged in advance by a corona discharger 15 for charging. The document image is imaged on the photosensitive member 14, and thereby an electrostatic latent image corresponding to the document image is formed. The electrostatic latent image is developed by a developing device 16 into a toner image, which is in turn transferred to one face of a recording sheet P by a corona discharger 17 for image transfer. The recording sheets P are contained in cassettes **18*a*, 18*b*, and 18*c* in advance, and fed one by one by transporting means 19*a*, 19*b*, and 19*c*. After being transported along a transport path 20, the recording sheets P are introduced to a transfer region 21** in which an image transferring operation is carried out.

In a position of the transport path 20 in the vicinity of the transfer region 21 are arranged a pair of registration rollers 22. With rotatable shafts of the registration rollers 22 are coupled a torque transmission mechanism through unillustrated clutches. These clutches are controllably engaged or disengaged based on a control of a transport timing of the document D in the document feeder 2 so as to time a transport of the recording sheet P by means of the registration rollers 22 with movement of the toner image on the photosensitive member 14. The recording sheet P having the toner image transferred thereto by the transfer corona discharger 17 is introduced by a transporting means 26 to a fixing device 27, in which the toner image is fixed onto the recording sheet P.

The recording sheet P having the toner image fixed thereon has a transport direction thereof reversed by an inverting means 23, and is contained in an intermediate tray 24 temporarily. The recording sheet P in the intermediate tray 24 is refed to the transport path 20 by a transporting means 25, is introduced to the transfer region 21 again by the registration rollers 22, and has another toner image transferred to the other face thereof. The recording sheet P having passed through a copying operation is discharged onto a discharge tray 30 provided outside the machine through the transporting means 26, the fixing device 27, a transport path 28, and a discharge mechanism 29. In this way, the images of the corresponding documents are copied on to both faces of the corresponding recording sheets P.

In the case of simplex copying, the recording sheet P having the image copied on one face thereof is discharged onto the discharge tray 30 without being contained in intermediate tray 24. The cassettes 18*a*, 18*b*, and 18*c* contain, for example, mutually different sized recording sheets P respectively, and the recording sheets P are selectively transported to the transfer region 21.

A construction of the document feeder 2 will be described next with reference to FIG. 2. The documents D to be copied are stacked and placed in the document container 6. In the document container 6 is provided a pair of aligning plates 42 which extend in parallel with a feeding direction 41, and are opposed to each other in a widthwise direction of the documents D. The aligning plates 42 move close to or away from each other in the opposing direction according to the width of the documents to be stacked, thereby aligning opposite lateral edges of the documents D. In other words, the center lines of the documents D to be stacked with respect to the widthwise direction is always fixedly located regardless of the width of the documents D.

Downstream from the document container 6 with respect to the feeding direction is provided a feeding means 43 for feeding the documents D one by one. The feeding means 43 is provided with a suction transporting means 44 disposed, for example, below the document container 6, and an exhaust duct 45 disposed above the document container 6. The suction transporting means 44 includes two drive rollers 46, 47 having axes perpendicular to the feeding direction 41, and an endless belt 48 having a multitude of apertures defined therein which is wound on the rollers 46, 47. Inward of the belt 48 is disposed an unillustrated suction duct. The suction force acts through the belt 48 from the suction duct by driving an unillustrated suction fan, and thereby the bottommost one of the stacked documents D is sucked by the belt 48. Accordingly, the documents D are sequentially fed in the feeding direction 41 from the bottommost one by driving the belt 48 in a counterclockwise direction (see FIG. 2).

An air stream is injected to downstream edges of the documents D stacked at a lower side from a nozzle of the exhaust duct 45. This serves to separate the downstream edges of the documents D from one another, and accordingly enables the documents to be fed one by one more reliably by the suction transporting means 44. In this way, the stacked documents D can be sequentially fed from the bottommost one by the feeding means 43. It will be appreciated that a construction of the feeding means 43 is not limited to this.

The document D fed by the feeding means 43 is transported to an inverting means 50 by a pair of transport rollers 49. Downstream of the transport rollers 49 with respect to the feeding direction is arranged a first transport detector S1 including, for example, a light emitting element and photodetector. The one by one feed of the documents D is detected by the first transport detector S1.

The inverting means 50 is provided on the outer surface of a substantially cylindrical support cylinder 51. A transport path is branched into a first transport path 52 extending in a counterclockwise direction and a second transport path 53 extending in a clockwise direction at a position downstream of the transport rollers 49 and on the outer surface of the support cylinder 51. Along the first transport path 52 are provided transport rollers 54, 55 which are adapted to transport the document D pressingly against and along the outer surface of the support cylinder 51, and are reciprocally rotatable. There is also provided a second transport detector S2 including, for example, a light emitting element and a photodetector along the first transport path 52. A transported state of the document D transported along the first transport path 52 is detected by the first and second transport detectors S1, S2. Further, rotating timings and rotating directions of the transport rollers 54, 55 are controlled with the use of these detectors.

Along the second transport path 53 is provided a transport roller 56 which is adapted to transport the document pressingly against and along the outer surface of the support cylinder 51 and is rotatable only in one direction. There is also provided a third transport detector S3 including a light emitting element and a photodetector alone the second transport path 53. A transported state of the document D transported along the second transport path 53 is detected by the third transport detector S3. Further, a rotating timing or the like of the transport roller 56 is control led with the use of this detector.

The first transport path 52 and the second transport path 53 join in the vicinity of a contact piece 62 provided upstream from the transparent plate 5 with respect to a transport direction 57. Accordingly, the document D is transported up to the reading station 5*a* defined on the transparent plate 5 along the first transport path 52. In the case where the document D has faces thereof inverted, the document D positioned at the reading station 5*a* is introduced into the second transport path 53 from the first transport path 52 so as to transport the document D to the reading station 5*a* again. In this way, there can be realized document transporting methods based on various copy modes to be set.

Above the transparent plate 5 are arranged two rollers 58, 59 spaced apart from each other in the transport direction 57, the rollers 58, 59 having axes in parallel with the widthwise direction of the document D being fed, and a plurality of endless belts 60 wound on the rollers 58, 59. On the inner surfaces of the belts 60 at lower stretched portions 60a are arranged five press rollers 61*a* to 61*e* in this order along the transport direction 57. The press rollers 61*a* to 61*e* press the belts 60 against the transparent plate 5 so as to avoid the loosening of a stretching force of the belts 60 and to prevent the floating of the document D transported between the belts 60 and the transparent plate 5.

The document D is transported to the reading station 5*a* on the transparent plate 5 by the belts 60. The reading station 5*a* corresponds to a position where an upstream edge of the document D being transported is in contact with the contact piece 62 provided projectingly upstream from the transparent plate 5 with respect to the transport direction 57. More specifically, in the case where the document D is transported to the transparent plate 5, the contact piece 62 is fixed at a position in flush with the transparent plate 5, and the press roller 61*a* is moved upward away from the transparent plate 5 so as to attain a transport path to the transparent plate 5. When the document D is transported onto the transparent plate 5 and passage of the upstream edge thereof is detected by a document sensor S4 provided in the vicinity of the contact piece 62, the contact piece 62 is caused to project upward and the belts 60 are driven in the reverse direction until the document D comes to contact with the contact piece 62. At this time, the press roller 61*a* is pressed against the transparent plate 5.

In this way, the document D transported to the reading station 5*a* presents the image thereof toward the interior of the machine, and the document image is optically scanned by the optical reading means provided in the copying machine 1, and thereby the reading/exposing operation for the document image is executed.

Upon completion of the reading/exposing operation for the document image, the belts 60 are drivingly rotated again, and the document D is transported to a transport path 63. Thereafter, the document D is transported by a plurality of transport rollers 64 to 68 provided along the transport path 63, and is consequently placed at the top of the documents D stacked in the document container 6.

Along the transport path 63 is provided a transport detector S5 for detecting the transported state of the document D. The detector S5 is used to control driving timings of the respective transport rollers 64 to 68. Further, in the vicinity of the document container 6 is provided a circulation sensor S6 for detecting completion of one circulation of the stacked documents D. The circulation sensor S6 includes, for example, an actuating member 69 in contact with the uppermost one of the stacked documents D. When it is, for example, optically detected that no document D exists between the actuating member 69 and the document container 6 while the documents are fed, it is determined that all the stacked documents D have been circulated.

Figure 3:
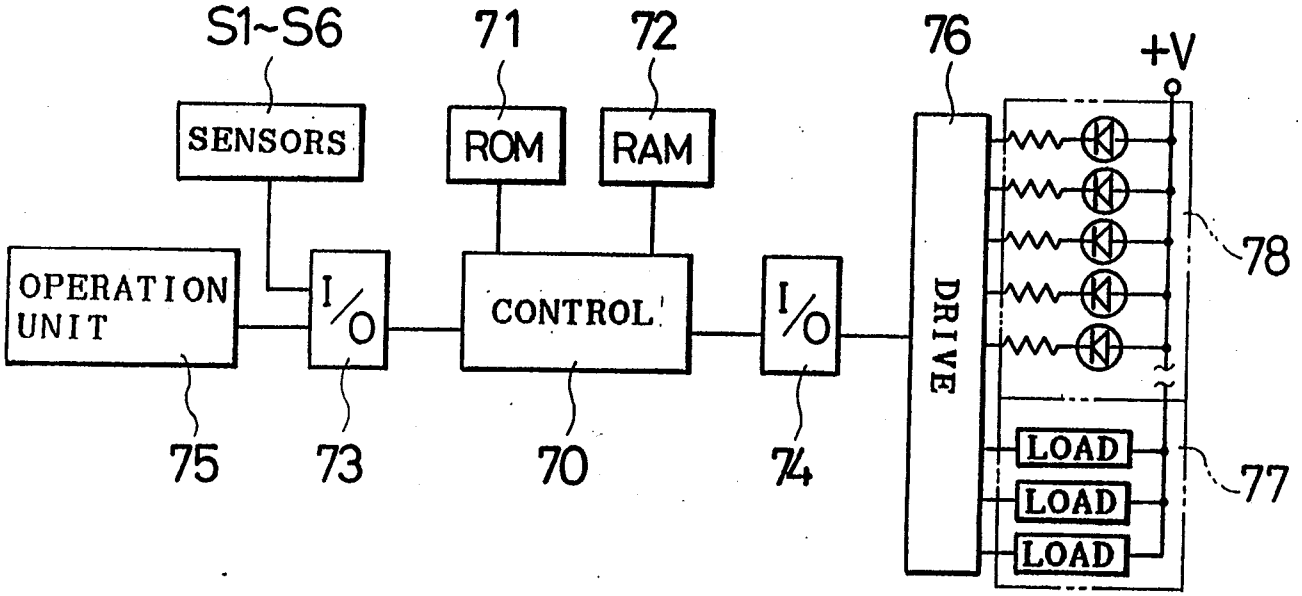
FIG. 3 is a block diagram showing an electric construction of the copying machine 1.

FIG. 3 is a block diagram showing an electric construction of the copying machine 1 shown in FIG. 1. A control circuit 70 including a microcomputer and adapted to control an overall operation of the copying machine executes controls in accordance with various control programs prestored in a ROM (read only memory) 71. A RAM (random access memory) 72 is used as a buffer memory and a calculation region for flags and the like which are required for copying control. An operation signal from an operation unit 75 and sensor signals from the various sensors S1 to S6 provided in the copying machine 1 and the document feeder 2 are applied to the control circuit 70 through an interface circuit (I/O) 73. A control signal from the control circuit 70 is applied to a drive circuit 76 through an interface circuit 74. The drive circuit 76 controls a display of the number of copies to be made in a display unit 78, displays in other display units, and a plurality of loads 77 exerted on motors and solenoids provided in the copying machine 1 and the document feeder 2.

Figure 4:
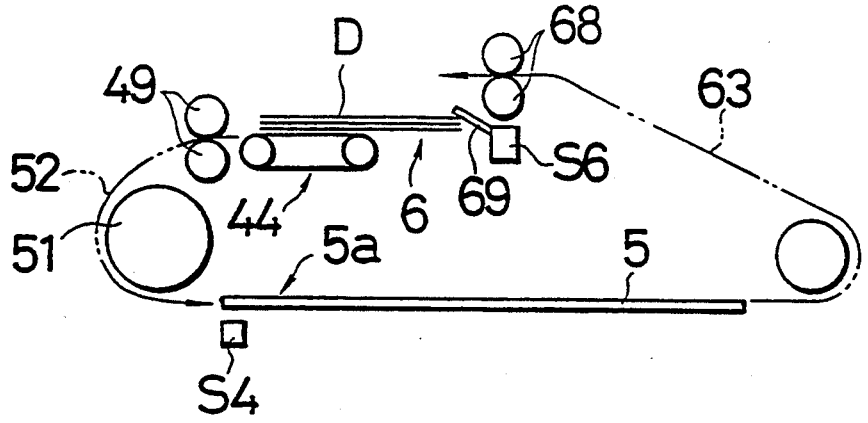
FIGS. 4(1), 4(2) are schematic side views showing an operation of the recirculating document feeder 2.
Figure 4:
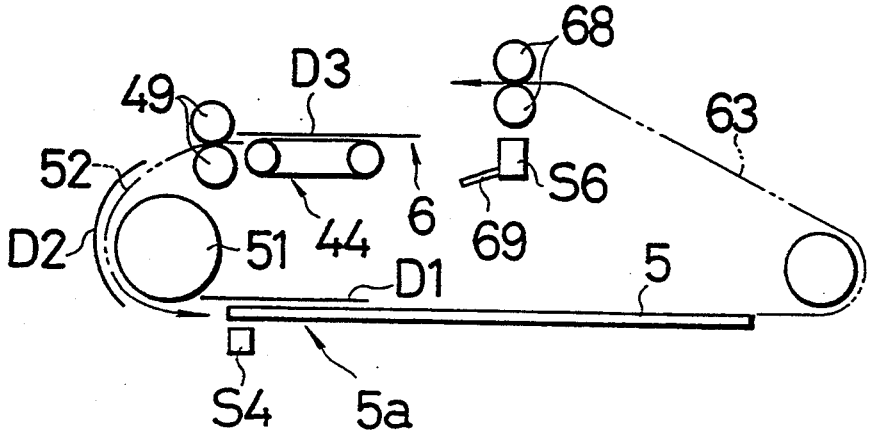

FIGS. 4(1), 4(2) are schematic side views showing an operation of the invention. The documents D stacked in the document container 6 are transported along the transport path 52 to the transparent plate 5 defining the reading station 5*a*, and then returned along the transport path 63 to the document container 6. At this time, when a relatively small number of documents are set as shown in FIG. 4(2), e.g. when the circulation sensor S6 detects that all of the documents have been fed before the first document D1 passes the reading station 5*a*, the circulation of the documents to count the number of the documents is stopped, and the reading/exposing operation is started at the reading station 5*a* for the first document D1.

In this way, when the number of the documents is detected before the first document D1 passes the reading station 5*a*, the copying machine directly proceeds to a copying operation without circulating the documents. Thus, the time required for the copying operation can be shortened compared to a case where the document in the state shown in FIG. 4(2) is returned to the document container 6 and is fed again for the copying operation from a state shown in FIG. 4(1), because the number of circulation of the documents can be reduced by one.

Figure 5:
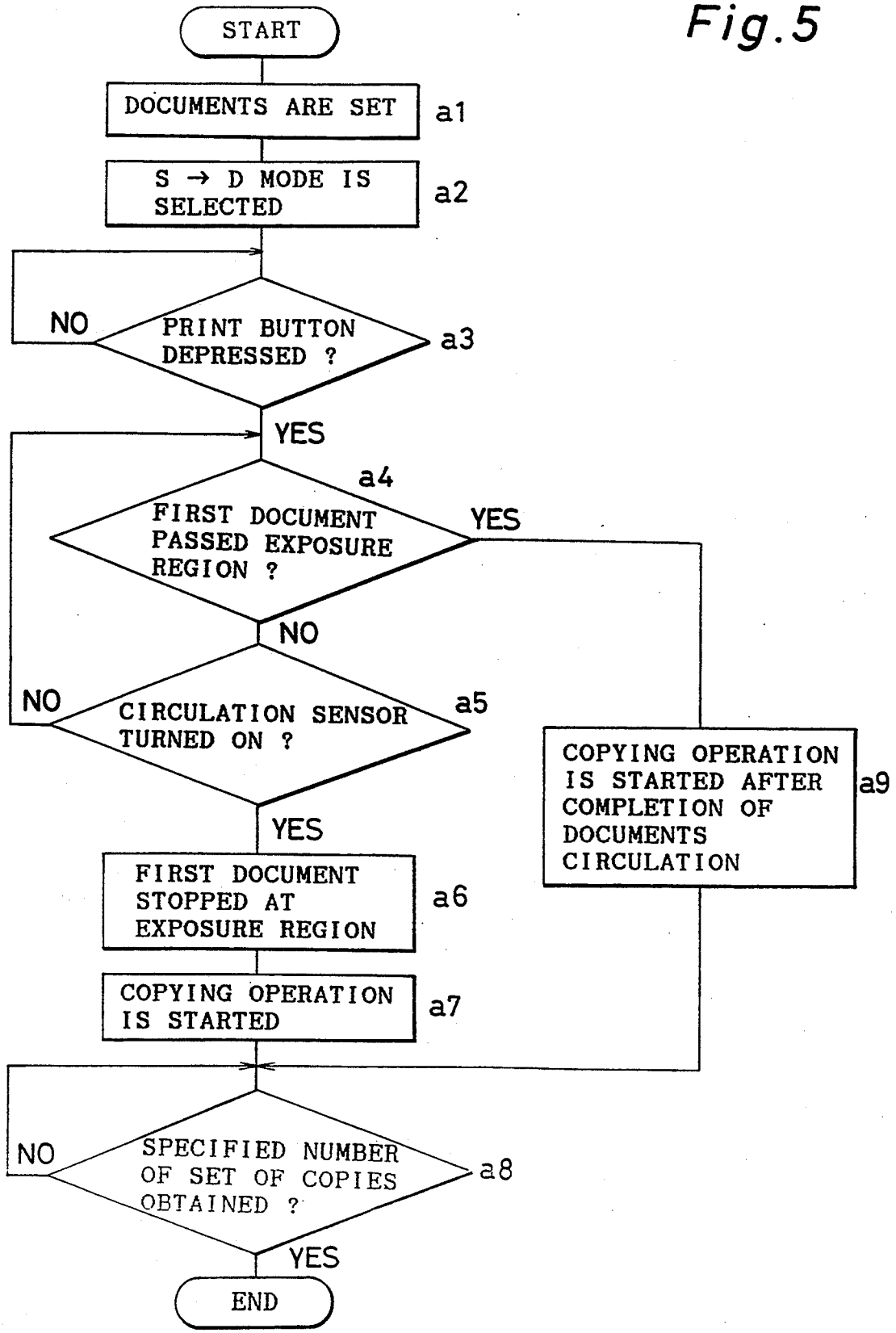
FIG. 5 is a flow chart showing an operation of the copying machine 1.

FIG. 5 is a flow chart showing the operation of the copying machine 1. In Step a1, the documents are set in the document container 6. When a copy mode in which duplex copies are made from simplex documents is selected in the operation unit 75 in Step a2, it is discriminated whether a print button has been depressed in Step a3. In the case where the print button has been depressed, this routine proceeds to Step a4 in which it is discriminated whether the first document D1 fed from the document container 6 has passed the exposure region, i.e. the reading station 5*a*. In the case where the discrimination result is in the negative, it is discriminated whether the circulation sensor S6 has been turned on, i,e. whether all the documents have been fed from the document container 6, in Step a5. This routine proceeds to Step a6 in the case where the discrimination result is in the affirmative, while returning to Step a4 in the case where the discrimination result is in the negative.

In the case where the discrimination result is in the affirmative in Step a5, i.e. all the documents have been fed before the first document D1 passes the reading station 5*a*, the first document D1 is caused to stop at the exposure region, i.e. the reading station 5*a*, in Step a6, and the copying operation is started in Step a7. Thereafter, the copying operation is completed when a specified number of sets of copies are obtained in Step a8.

In the case where the discrimination result is in the affirmative in Step a4, i.e. the first document D1 has passed the reading station 5*a* before the circulation sensor S6 is turned on, this routine proceeds to Step a9 in which the documents are circulated to count the number thereof. Upon completion of the circulation, the documents are fed again, thereby starting the copying operation. Thereafter, when the specified number of sets of copies are obtained in Step a8, the copying operation is completed.

As described above, according to this embodiment, in the case where it is detected by the circulation sensor S6 that all the documents have been fed before the first document passes the reading station 5*a* while the documents are circulated to count the number thereof prior to the copying operation, the counting operation is stopped, and the copying operation is immediately started. Thus, the circulation of the documents to count the number thereof can be omitted and thereby the time required to make copies can be shortened in the case where a relatively few number of documents are copied. The invention is particularly effective in the case where a transport distance between the document container 6 and the reading station 5*a* is long.

Figure 6:
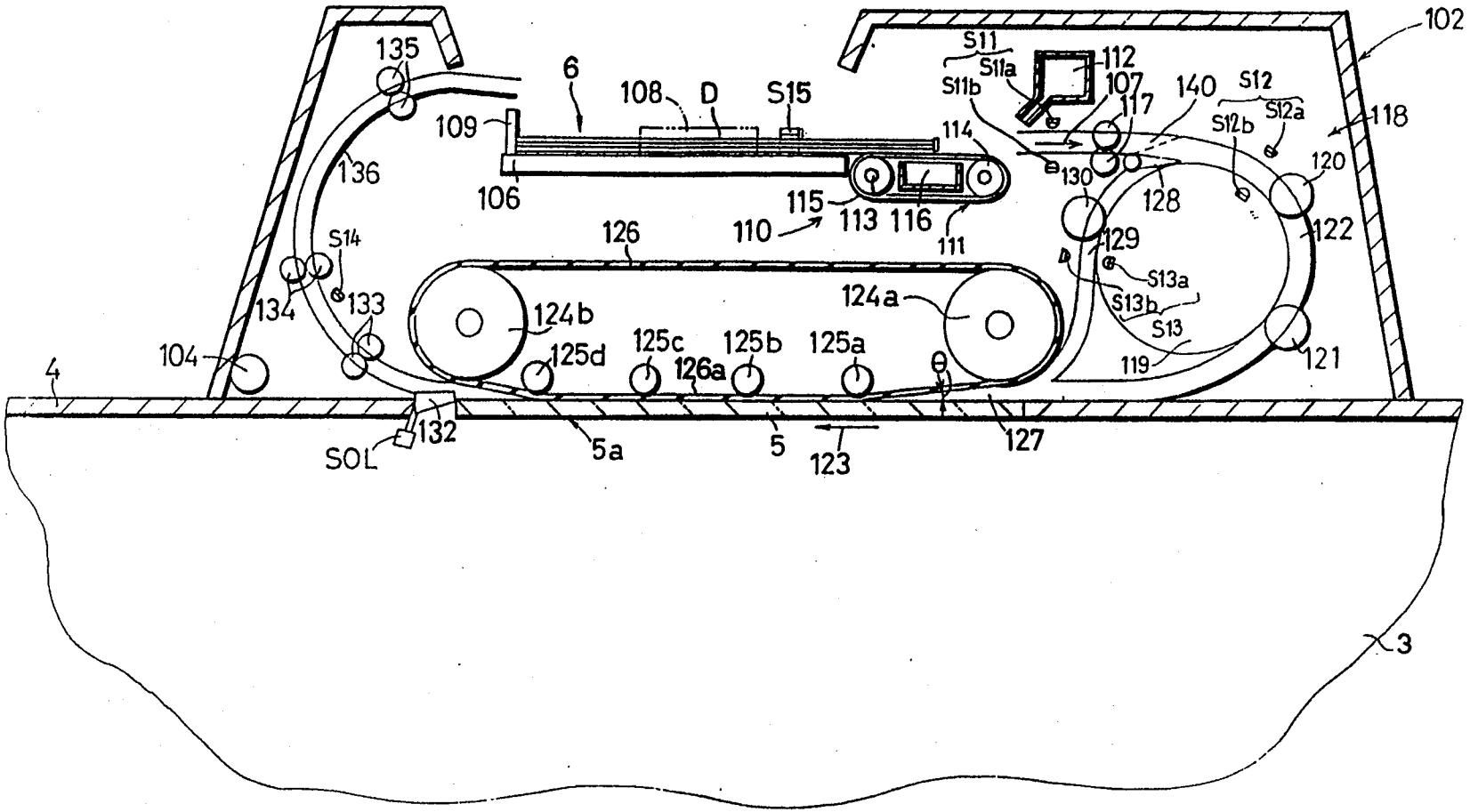
FIG. 6 is a sectional view showing a schematic construction of a recirculating document feeder 102 used in a second embodiment of the invention.

FIG. 6 is a schematic side view showing a second embodiment of the invention. In a document feeder 102 as a second embodiment, a distance between a document container 6 and a reading station 5a is long compared to the document feeder 2 of the foregoing embodiment. Accordingly, the invention can be implemented in the case where a larger number of documents are copied compared to the document feeder 2.

On a top surface 4 of a frame of a copying machine main body 3 is provided a transparent plate 5 made of hard glass or like material. The transparent plate 5 serves as a document reading plane. The document feeder 102 is provided above the transparent plate 5, and is mounted on the top surface 4 angularly displaceable about a rotatable shaft 104. In the case where the documents are not fed by means of the document feeder 102, e.g. in the case where the document is a book or the like, the document feeder 102 is angularly displaced about the rotatable shaft 104 to open the transparent plate 5, and a document such as a book is placed face downward on the transparent plate 5. The copying operation is executed while the document is fixedly pressed against the transparent plate 5.

Documents D to be copied are placed on a holding member 106. On the holding member 106 are arranged a pair of aligning plates 108 which extend in parallel with a feeding direction 107 and are opposed to each other in a widthwise direction. The aligning plates 108 move close to or away from each other in the opposing direction according to the width of the documents to be stacked, thereby aligning opposite lateral edges of the documents D. Downstream from the holding member 106 with respect to the feeding direction is provided a feeding means 110 for feeding the documents D one by one. The feeding means 110 is provided with a suction transporting means 111 disposed, for example, below the holding member 106, and an exhaust duct 112 disposed above the holding member 6.

The suction transporting means 111 includes two drive rollers 113,114 having axes perpendicular to the feeding direction 107, and an endless belt 115 having a multitude of apertures defined therein which is wound on the rollers 113,114. Inward of the belt 115 is disposed a suction duct 116. The suction force acts through the belt 115 from the suction duct 116 by driving an unillustrated suction fan, and thereby the bottommost one of the stacked documents D is sucked by the belt 115. Accordingly, the documents D are sequentially fed in the feeding direction 107 from the bottommost one by driving the belt 115 in a clockwise direction.

An air stream is injected to downstream edges of the documents D stacked at a lower side from a nozzle of the exhaust duct 112. This serves to separate the downstream edges of the documents D from one another, and accordingly enables the documents to be fed one by one more reliably by the suction transporting means 111.

The document D fed by the feeding means 110 is transported to a transport path 140 and an inverting means 118 through a pair of transport rollers 117. Downstream of the holding member 106 with respect to the feeding direction is arranged a first transport detector S11 including a light emitting elements S11a and photodetectors S11b. The one by one feed of the documents D is detected by the first transport detector S11.

The inverting means 118 is provided on the outer surface of a substantially cylindrical support cylinder 119. The transport path 140 including the transport roller 117 is branched into a first transport path 122 extending in a clockwise direction and a second transport path 129 extending in a counterclockwise direction at a position on the outer surface of the support cylinder 119. Along the first transport path 122 are provided transport rollers 120, 121 which are adapted to transport the document D pressingly against and along the outer surface of the support cylinder 119, and are reciprocally rotatable. There is also provided a second transport detector S12 including a light emitting elements S12a and a photodetectors S12b along the first transport path 122. A transported state of the document D transported along the first transport path 122 is detected by the second transport detectors S12. Further, rotating timings and rotating directions of the transport rollers 120, 121 are controlled with the use of this detector.

Along the second transport path 129 is provided a transport roller 180 which is adapted to transport the document pressingly against and along the outer surface of the support cylinder 119 and is rotatable only in one direction. There is also provided a third transport detector S13 including a light emitting elements S13a and a photodetectors S13b along the second transport path 129. A transported state of the document D transported along the second transport path 129 is detected by the third transport detector S13. Further, a rotating timing or the like of the transport roller 130 is controlled with the use of this detector.

At the junction of the first transport path 122 and the second transport path 129 is provided a direction changing claw 128 which is driven by an unillustrated solenoid. For instance, when the solenoid is deenergized, the claw 128 is in a position as indicated by a solid line in FIG. 6, thereby opening a path to transport the document toward the first transport path 122. On the other hand, when the solenoid is energized, the claw 128 is angularly displaced to a position as indicated by a dotted line in FIG. 6, thereby opening a path to transport the document from the first transport path 122 to the second transport path 129. The solenoid is switchingly controlled based on, for example, the detection result of the second transport detector S12.

The other ends of the first transport path 122 and the second transport path 129, which are opposite to the ends thereof where the claw 128 is provided, join in the vicinity of an upstream end of the transparent plate 5 with respect to the feeding direction 123.

Above the transparent plate 5 are arranged two rollers 124a, 124b spaced apart from each other in the transport direction 123, the rollers 124a, 124b having axes in parallel with the widthwise direction of the document D being fed, and a plurality of endless belts 126 wound on the rollers 124a, 124b. On the inner surfaces of the belts 126 at lower stretched portions 126a are arranged a plurality of press rollers 125a to 125d in this order along the transport direction 123. The press rollers 125a to 125d press the belts 126 against the transparent plate 5 so as to avoid the loosening of a stretching force of the belts 126 and to prevent the floating of the document D transported between the belts 126 and the transparent plate 5.

In this document feeder 102, there is defined a clearance between the belts 126 and the transparent plate 5 at the upstream side of the plate 5 with respect to the transport direction 123 because the stretched position of the belts 126 at the roller 124a is at a higher level than that of the belts 126 at the most upstream located press roller 125a. In other words, the belts 126 are inclined relative to the transparent plate 5 by a specified angle $\theta$ with the press roller 125*a* as a base point in a portion upstream from the press roller 125*a* with respect to the transport direction.

In the document feeder 102, this clearance forms a third transport path 127 which is in communication with the first transport path 122 and the second transport path 129 in the inverting means 118. Accordingly, even when the belts 126 are not driven, the document D can be transported into the third transport path 127 by the transporting force of the respective transport rollers 120, 121, and 130 in the inverting means 118.

The document D transported over the transparent plate 5 by the belts 126 is transported to the reading station 5*a* defined on the transparent plate 5. The reading station 5*a* corresponds to a position where an upstream edge of the document D being transported is in contact with the contact piece 132 provided projectingly upstream from the transparent plate 5 with respect to the transport direction 123. In this way, the document D transported to the reading station 5*a* presents the image thereof toward the interior of the machine, and the document image is optically scanned by the optical reading means provided in the copying machine 1, and thereby the reading/exposing operation for the document image is executed.

Upon completion of the reading/exposing operation for the document image, the contact piece 132 is driven to be angularly displaced by means of a control of a solenoid SOL, thereby opening a path leading from the reading station 5*a* to the transport path 136. At the same time, the belts 126 are drivingly rotated again, and the document D is transported to the transport path 136 by the transport rollers 133 to 135. Thereafter, the document D is returned and placed at the top of the documents D stacked on the holding member 106.

Along the transport path 136 is provided a transport detector S14 for detecting the transported state of the document D, or the like. A driving timing of the solenoid SOL is controlled based on the output of the detector S14. Further, in the vicinity of the holding member 106 is provided a circulation sensor S15 for detecting completion of one circulation of the stacked documents D. The circulation sensor S15 includes, for example, an actuating member in contact with the uppermost one of the stacked documents D. When it is, for example, optically detected that no document D exists between the actuating member and the holding member 106 while the documents are fed, it is determined that all of the stacked documents D have been circulated.

Figure 8:
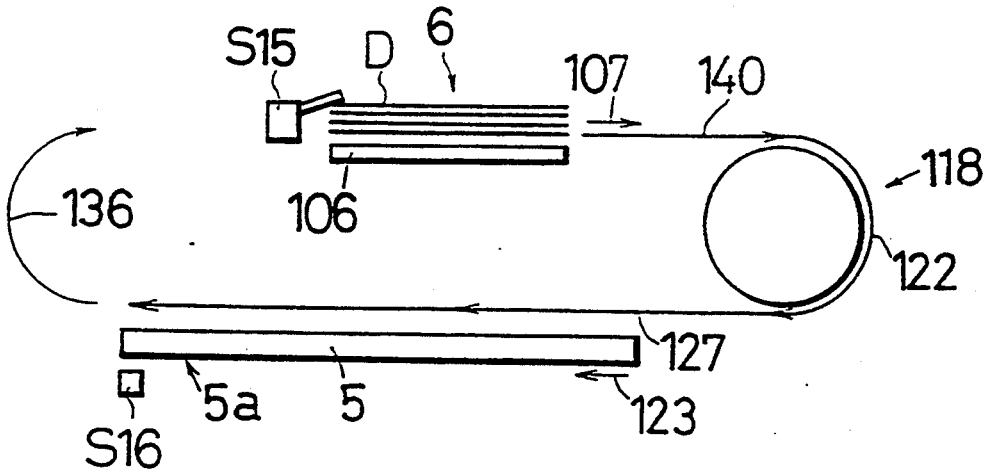
FIGS. 8(1), 8(2) are schematic side views showing the second embodiment of the invention.
Figure 8:
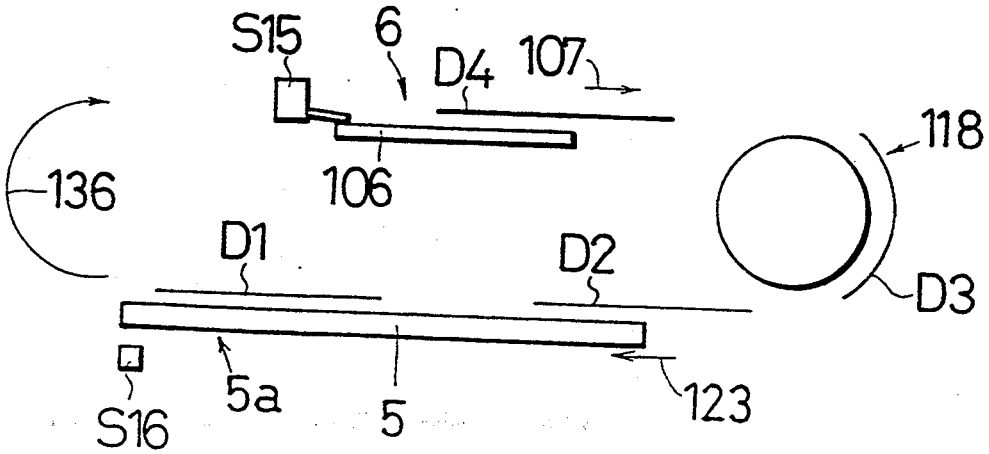

FIG. 7 is a flow chart showing an operation of the second embodiment of the invention, and FIGS. 8(1), 8(2) are schematic side views showing the operation in the second embodiment of the invention. In Step b1, the documents are set on the holding member 106 as shown in FIG. 8(1). When a copy mode in which duplex copies are made from simplex documents is selected in an operation panel in Step b2, it is discriminated whether a print button has been depressed in Step b3. The copying machine 1 circulatorily feeds the documents one by one so as to count the number of the documents when the print button is depressed.

In Step b4, it is discriminated whether the first document D1 fed from the holding member 106 has passed the exposure region, i.e. the reading station 5*a*. This discrimination is made based on whether a document sensor S16 provided in the vicinity of a downstream end of the reading station 5*a* has detected the downstream edge of the first document D1. In the case where the discrimination result is in the negative, this routine proceeds to Step b5 in which it is discriminated whether the circulation sensor S15 has been turned on, i.e. the feeding of all the documents has been completed.

This routine returns to Step b4 in the case where the discrimination result is in the negative, while proceeding to Step b6 in the case where the discrimination result is in the affirmative. In Step b6, the first document D1 is caused to pause at the exposure region, i.e. the reading station 5*a*, and the copying operation is started in Step b7. In other words, the number of the documents is determined when it is detected that all the documents have been fed before the first document reaches the reading station 5*a*. Accordingly, the copying operation can be started immediately without circulating the documents to count the number thereof. Thereafter, the copying operation is completed when a specified number of sets of copies are obtained in Step b8.

In the case where the discrimination result is in the affirmative in Step b4, this routine proceeds to Step b9. More specifically, in the case where the circulation sensor S15 has not detected one circulation of the documents when the first document D1 reaches the reading station 5*a* serving as an exposure region, the circulation of the documents to count the number thereof is continued. Upon completion of the circulation, the documents are fed again, thereby starting the copying operation. Thereafter, when the specified number of sets of copies are obtained in Step b8, the copying operation is completed.

In this embodiment, effects similar to the foregoing embodiment can be obtainable. Particularly, in the document feeder 102 of the second embodiment, the transport distance between the holding member 106 and the reading station 5*a* is long compared to the document feeder 2 of the first embodiment. Accordingly, the invention can be implemented in the case where a larger number of documents are copied compared to the first embodiment.

Figure 9:
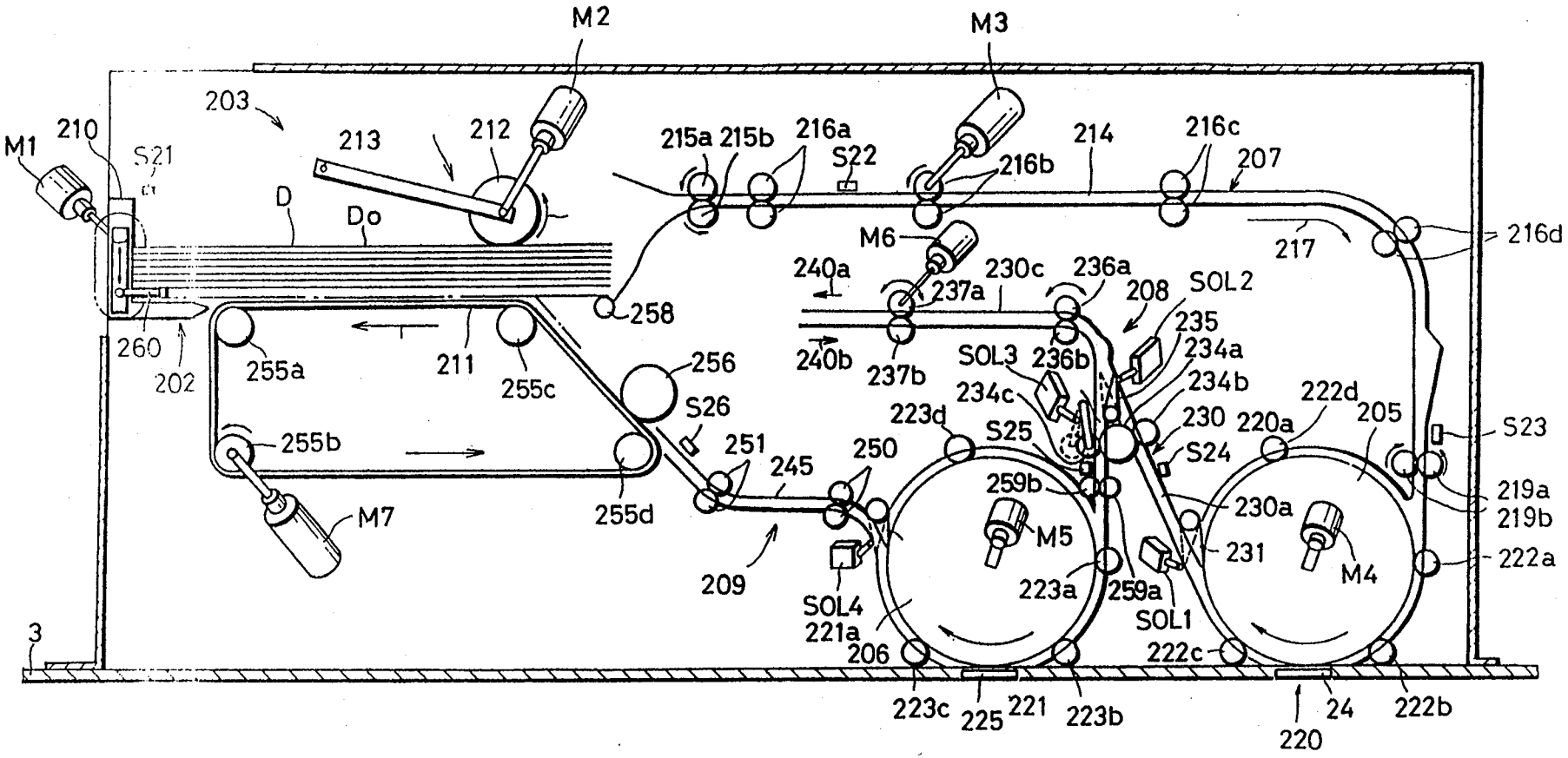
FIG. 9 is a sectional view showing a schematic construction of a recirculating document feeder 201 used in a third embodiment of the invention.

FIG. 9 is a schematic sectional view showing a third embodiment of the invention. A document feeder 201 used in this embodiment includes a document container 202 for containing documents therein, a feeding means 203, a first support cylinder 205, a second support cylinder 206, a document transporting means 207, a document inverting means 208, and a document returning means 209. The feeding means 203 feeds the documents one by one from the document container 202. The first support cylinder 205 transports the document along the outer surface thereof so as to cause one face of the document to face a first reading station 220. The second support cylinder 206 causes the other face of the document being transported to face a second reading station 221. The document transporting means 207 transports the document from the document container 202 to the first support cylinder 205. The document inverting means 208 is provided between the first support cylinder 205 and the second support cylinder 206, and is adapted to invert a transported state of the document so that the face of the document which faces the second reading station 221 is the other face of the one which has faced the first reading station 220. The document returning means 209 returns the document from the second support cylinder 206 to the document container 202.

In the document container 202, for example, a plurality of sheet-like documents D having images on one face thereof are placed on a document transport belt 211 in such a manner that the image faces face that document transport belt 211 while first edges thereof (left edges in FIG. 9) are aligned by an edge aligning member 210. In order to feed the documents D placed in the document container 202 one by one from the uppermost one to the transporting means 207, there is provided above the document container 202 a feed roller 212 constituting the document feeding means 203. The feed roller 212 is drivingly rotated in an arrow direction at a predetermined timing by a document feed motor M2, and is pressed against the uppermost document D0 through a lever 213 by the force given from a solenoid or the like while being rotated. In this way, the documents D can be fed one by one from the document D0 to the document transporting means 207.

The document transporting means 207 to which the documents D are fed one by one from the document container 202 by the feed roller 212 includes a transport path 214 which is curved downward from the horizontal direction to the vertical direction as shown in FIG. 9. At an inlet end of the transport path 214 are provided separating rollers 215*a*, 215*b* for preventing a multiple feed of the documents D. The upper roller 215*a* is drivingly rotated in such a direction as to transport the documents, whereas the lower roller 215*b* is drivingly rotated in such a direction as to return the documents. The documents D can be separated and fed into the transport path 214 one by one reliably by causing the documents to pass between these rollers 215*a* and 215*b*. Pairs of transport rollers 216*a*, 216*b*, 216*c*, and 216*d* are provided along the transport path 214 at specified spacings in a transport direction.

These pairs of rollers 216*a* to 216*d* come to contact with both faces of the document D rotatably respectively. By rotating the rollers 216*a* to 216*d* forcibly by means of a document transport motor M3, the document D is transported in an arrow direction 217 along the transport path 214 while being guided by these rollers. A document feed detector S22 is provided at the inlet end of the transport path 214, and a first detector S23 located upstream from a first reading station is provided at an outlet end thereof.

At the outlet of the transport path 214 (in the vicinity of a first support cylinder 205) are provided a pair of first registration rollers 219*a*, 219*b*. The first registration rollers 219*a*, 219*b* are coupled with a drive shaft through clutches although unillustrated, and the driving thereof is stopped and resumed by an on-off control of the clutches. The on-off control of the clutches is executed in accordance with a copy mode the operator desires. More specifically, in the case where the reading of the document D is necessary, the driving of the rollers 219*a*, 219*b* is stopped to cause the document D to wait thereat in order to synchronize the transport of the document D with the transport of a recording sheet in a copying machine main body 3, and is then resumed to transport the document D to the first support cylinder 205 after the synchronization.

On the other hand, in the case where the reading of the document D is unnecessary, the rollers 219*a*, 219*b* are always rotated merely as transport rollers similar to the other transport rollers so as to transport the document D without causing the same to stop thereat.

A reading station where the image of the document D is read includes a first reading station 220 and a second reading station 221 respectively corresponding to lowest end surfaces of the first support cylinder 205 and the support cylinder 206 arranged in parallel and spaced apart in the transport direction. The first reading station 220 and second reading station 221 are located on the same plane as illustrated.

The respective support cylinders 205, 206 are drivingly rotated in a clockwise direction (see FIG. 9) at a speed synchronizing a copying speed at which the image is copied on the recording sheet by document transport motors M4, M5. Further, driven rollers 222*a* to 222*d*, 223*a* to 223*d* are arranged along the outer surfaces of the respective support cylinders 205, 206 at specified spacings. The document D is pressed against the respective outer surfaces by these driven rollers, thereby being rolled around the support cylinders 205, 206. In this way, the document D is transported along circumferential transport paths 220*a*, 221*a* formed on the outer surfaces of the support cylinders 205, 206.

Right below the circumferential transport paths 220*a*, 221*a* are placed hard transparent glass plates 224, 225, which constitute the first and second reading stations 220, 221.

When the document D passes between the first support cylinder 205 and the first transparent glass plate 224, one face of the document D is exposingly read, and thereby an image corresponding to the one face is formed. When the document D passes between the second support cylinder 206 and the second transparent glass plate 225, the other face of the document D is exposingly read, and thereby an image corresponding to the other face is formed as will be described later.

The document D is transported to the first reading station 220 through the transport path 214 of the document transporting means 207, by the transporting force of the first registration rollers 219*a*, 219*b*, and while being rolled around the first support cylinder 205. Between the first support cylinder 205 and the second support cylinder 206 is provided the document inverting means 208 including an inverting path 230 in which the face of the document D facing the reading station is switched as illustrated. The inverting path 230 includes a first path 230*a* and a second path 230*b* which extend slantingly upward from opposing portions of the circumferential transport paths 220*a*, 221*a* of the first support cylinder 205 and the second support cylinder 206, and a third path 230*c* extending horizontally to the left from a junction of the paths 230*a*, 230*b*.

A direction changing claw 231 is provided at an inlet portion of the first path 230*a* in communication with the circumferential transport path 220*a* of the first support cylinder 205. The document D is selectively transported into the first path 230*a* or into the circumferential path 220*a* of the first support cylinder 205 by actuating the direction changing claw 231 by means of a solenoid. More specifically, in the case where one reading/exposing operation is sufficient, the direction changing claw 231 is actuated to a solid line position in FIG. 9 so as to transport the document D into the first path 230*a*. On the other hand, in the case where the reading/exposing operation is required to be executed a plurality of times, the direction changing claw 231 is actuated to a two dot chain line position so as to transport the document along the circumferential transport path 220*a* of the first support cylinder 205 a plurality of times.

Upon completion of the reading/exposing operation, the direction changing claw 231 is actuated to the solid line position to transport the document D into the first path 230*a*. Along the first path 230*a* are provided a trailing edge detector S24 for defecting a trailing edge of the document D, a pair of rollers 234*a*, 234*b*, and a direction changing claw 235 in this order from an upstream side of the transport direction of the document D. The document inverting operation described below is controlled in accordance with a sensor signal from the detector S24.

The rollers 234*a*, 234*b* are drivingly rotated, and thereby the document D is transported to the third path 230*c* through the direction changing claw 235. Along the third path 230*c* are arranged pairs of transport rollers 236*a*, 236*b*, 237*a*, 237*b*. The rollers 236*a*, 237*a* are rotated reciprocally by a motor M6 used to invert the document. These transport rollers 236, 237 transport the document D from the direction changing claw 235 in an arrow direction 240*a* along the third path 230*c*, and then transport the same in an arrow direction 240*b* because the rotation of the motor M6 is reversed when the trailing edge of the document D passes the direction changing claw 235.

The direction changing claw 235 is brought into a state indicated by a solid line in FIG. 9 by a solenoid SOL2, thereby closing the first path 230*a* while opening the second path 230*b* relative to the third path 230*c*, so that the document D is transported into the second path 230*b*. Along the second path 230*b* is provided a roller 234*c*, which is pressed against the roller 234*a* by means of a solenoid SOL3. The document D is transported while being tightly held between the rollers 234*a* and 234*c*.

Downstream from the roller 234*c* with respect to the transport direction is provided a second detector S25 located upstream from the second reading station and adapted to detect the leading edge of the document D. Further, downstream from the second detector S25 is provided a pair of second registration rollers 259*a*, 259*b*. These second registration rollers 259*a*, 259*b* are coupled with a drive shaft through clutches, and the driving thereof is stopped and resumed in accordance with an on-off control of the clutches.

More specifically, in the case where the reading of the document D is necessary, the driving of the rollers 259*a*, 259*b* is stopped to cause the document D to wait thereat in order to synchronize the transport of the document D with the transport of the recording sheet, and then resumed to transport the document D to the second support cylinder 206 after the synchronization. On the other hand, in the case where the reading of the document D is unnecessary, the rollers 259*a*, 259*b* are rotated merely as transport rollers so as to transport the document D without causing the same to stop thereat.

As described above, the transport direction of the document D is reversed in the inverting path 230. Accordingly, the document D is transported while being rolled around the second support cylinder 206 in such a manner that one face of the document D which has faced the first reading station 224 faces the outer surface of the cylinder 206, and the other face thereof which has not yet faced the reading station 224 is faced outward. Thus, the other face of the document D is exposingly read at the second reading station 221, and the image corresponding to the other face is formed.

A direction changing claw 246 is provided at a specified circumferential position of the second support cylinder 206 where the circumferential transport path 221*a* is branched into a transport path 245 of the document returning means 209. The direction changing claw 246 is actuated by a solenoid SOL4, and selectively opens or closes the circumferential transport path 221*a* to the transport path 245.

More specifically, in the case where the one reading/exposing operation is sufficient, the circumferential transport path 221*a* is open to the transport path 245, and thereby the document D is transported into the transport path 245. On the other hand, in the case where the reading/exposing operation is required to be executed a plurality of times, the transport path 245 is closed, and the document D is transported into the transport path 245 after being transported along the circumferential transport path 221*a* a required number of times.

In the document returning means 209 for returning the document D from the second reading station 221 to the document container 202, the transport path 245 is connected to a lower side end of the transport belt 211. The document D is transported to the transport belt 211 along the path 245. More specifically, pairs of transport rollers 250, 251 are arranged along the transport path 245 so as to transport the document D. In the vicinity of an outlet of the transport path 245 is provided a document detector S26 for detecting passage of the document D. The operations of the transport belt 211 and the document returning means 209 are controlled in accordance with a sensor signal from the detector S26.

The endless transport belt 211 is wound on rollers 255*a*, 255*b*, 255*c*, and 255*d* spaced apart vertically and horizontally as illustrated. The transport belt 211 is rotated in a counterclockwise direction (see FIG. 9) by drivingly rotating the drive roller 255*b* in an arrow direction by means of a motor M7 in accordance with the sensor signal from the detector S26. An upper stretched portion of the transport belt 211 serves as a holding portion for the documents D. Further, a pinch roller 256 is provided in a position in the vicinity of the transport path 245, and feeds the document D to a position between the upper stretched portion of the transport belt 211 and the bottommost one of the stacked documents D by the transporting force produced between the roller 256 and the transport belt 211.

In order to feed the document to the position between the upper stretched portion and the bottommost document, a document lifting roller 258 is provided below the downstream ends of the documents D stacked in the document container 202. This roller lifts the right ends of the stacked documents D in FIG. 9 from the transport belt 211 temporarily, thereby reliably enlarging an opening for feeding the document below the bottommost document. When the leading edge of the document D fed below the bottommost document reaches the edge aligning member 210, the driving of the motor M7 for rotating the transport belt 211 is stopped, thereby completing the document returning operation to the document container 202.

As illustrated, the document container 202 is further provided with an actuating member 260 formed of, for example, glossy finished stainless steel plate and adapted to detect one circulation of the stacked documents D. This actuating member 260 is in a lower end position indicated by a solid line in FIG. 9 before the operator places the documents D in the document container 202, and accordingly the documents D are placed on the actuating member 260. As the documents D are fed one by one from the document container 202 and returned thereto again, the actuating member 260 moves upward gradually and is located between the last document and the first document. Thus, the actuating member 260 distinguishes the documents which have not been fed yet from those which have been fed already. When all the documents D are circulated, the actuating member 260 reaches an upper end position indicated by a two dot chain line.

Upon arrival at the upper end position, the actuating member 260 has its exposed state detected by a circulation detector S21 provided in the document container 202. The detector S21 includes, for example, a combination of a light emitting element and a photodetector. The detector S21 in turn sends a sensor signal representative of completion of one circulation. In accordance with this sensor signal is controlled an operation of the copying machine main body 3 such as execution of the copying operation by the number of times corresponding to the number of sets of copies the operator desires to obtain. Thereafter, the actuating member 260 is rotated by 180 degrees by driving a motor M1 and is returned to the lower end position (original position) below the documents D.

Figure 10:
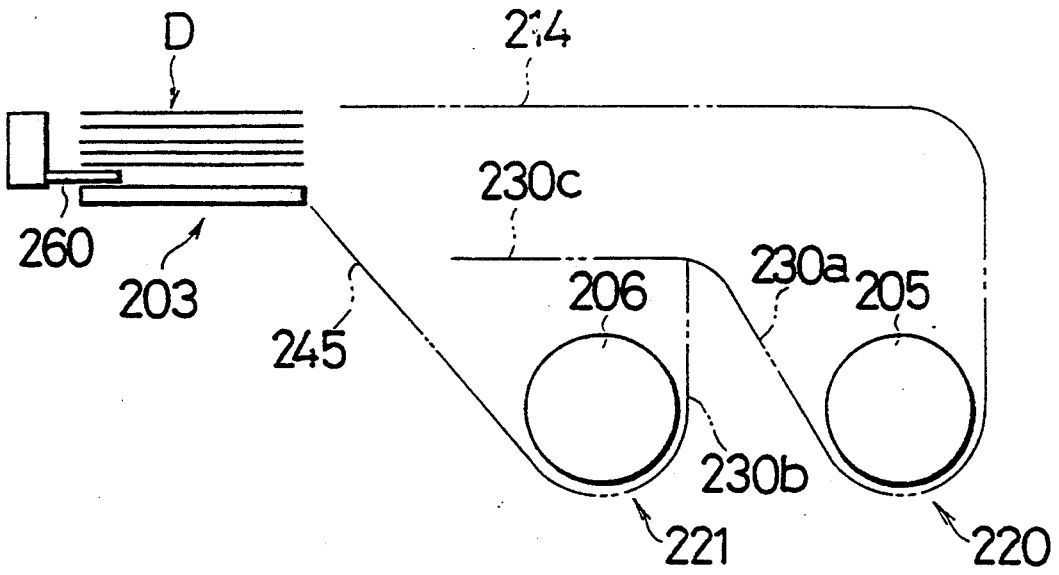
FIGS. 10(1), 10(2) are schematic side views showing the third embodiment of the invention.
Figure 10:
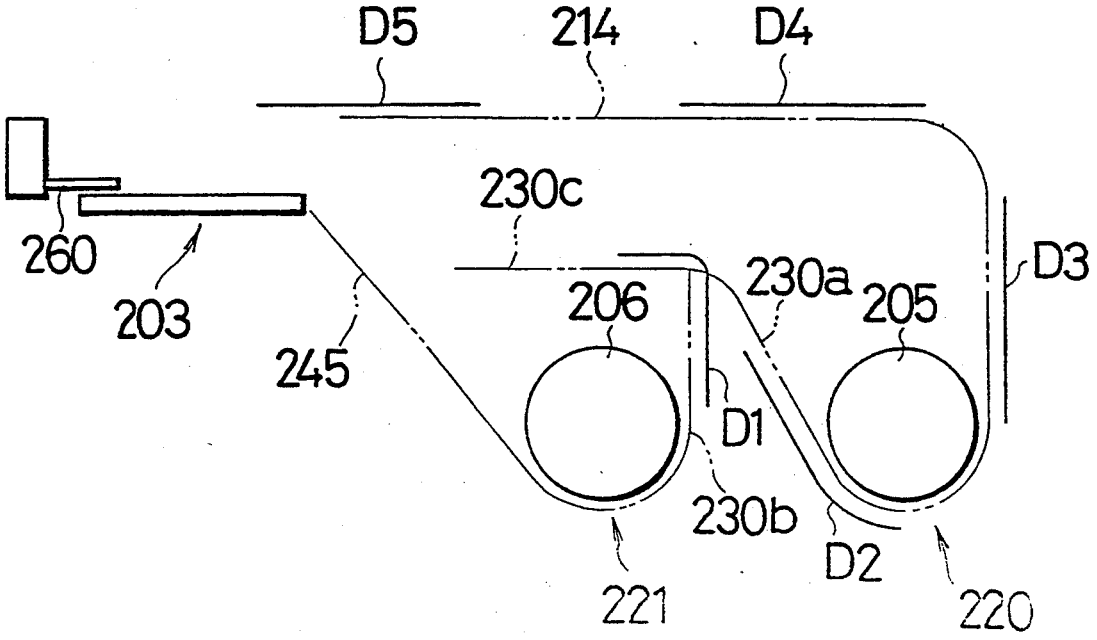

FIGS. 10(1), 10(2) are schematic side views showing the operation of the document feeder 201 used in the third embodiment of the invention. As shown in FIG. 10(1), a plurality of sheet-like documents D placed on the document container 203 are introduced to the first support cylinder 205 through the transport path 215, and are then introduced to the transport path **230*c* through the transport path 230*a* after passing the first reading station 220. After having the transport direction thereof reversed in the transport path 230*c*, the documents D are introduced to the second support cylinder 206 through the transport path 230*b*, and are then returned to the lowest part of the document container 203 through the transport path 245 after passing the second reading station 221**.

In the case where the documents D to be copied are simplex documents and are placed on the document container 203 with the image faces thereof faced downward, the faces of the documents D are opposite to the image faces facing the first reading station 220. Thus, the document images are exposingly read at the second reading station 221 after the documents D are inverted. At this time, in the case where a copy mode is selected in the copying machine in which duplex copies are made from simplex documents, it is necessary to circulate the documents so as to count the number thereof prior to the copying operation.

As shown in FIG. 10(2), when the last document, e.g. the fifth document D5 is fed to the transport path 214 from the document container 203 before the first document D1 reaches the second reading station 221, precisely before the leading edge of the document D1 is detected by the document detector S25 provided along the transport path **230*b*, it is detected that the last document has been fed by means of the actuating member 260 serving as a circulation sensor. Thereupon, the counting operation for the documents is stopped, and the reading/exposing operation for the documents is started at the second reading station 221**.

In this way, in the case where a relatively small number of documents are set and the number of the documents is detected before the first document D1 reaches the second reading station 221 in the circulation of the documents for counting the number thereof, the copying operation is started immediately. Thus, the number of circulation of the documents can be reduced by one, and a time required for making the duplex copies from the simplex documents can be shortened. The invention is particularly effective in the case where the transport path extending from the document container to the reading station is long.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A copying machine provided with a recirculating document feeder comprising:

means for supporting a plurality of documents therein in a stacked state;

means for separating and feeding said plurality of documents one by one from said means for supporting;

means for transporting the documents from the means for feeding to an exposure region;

means for returning the documents from the exposure region to said means for supporting;

means for counting the number of the documents in accordance with an output from a document counting device provided at a downstream side of the means for separating and feeding with respect to a transport direction;

first detecting means, provided in association with said means for supporting, for detecting that a last one of said plurality of documents in said means for supporting has been fed; and second detecting means, provided in the vicinity of the exposure region, for detecting whether a first one of said plurality of documents has reached the exposure region;

means, responsive to said first and second detecting means, for computing a counting by said means for counting upon detecting both the feeding of the last one of said plurality of documents and the first one of said plurality of documents reaching the exposure region, and for further immediately starting the copying operation within a same circulation only if the last one of the plurality of documents is detected at said means for supporting prior to a first document reaching said exposure region.

2. The copying machine according to claim 1, wherein said plurality of documents are circulated to count the number thereof in the case where duplex copies are made from a plurality of simplex documents and the feed of the documents is started from the last one of said plurality of documents.

3. The copying machine according to claim 1, wherein a plurality of simplex documents are contained in a state where image faces thereof are faced downward, the means for feeding feeds the documents from the uppermost one, and the means for returning returns the document to a position below the bottommost one of the stacked documents in the recirculating document feeder.

4. The copying machine according to claim 1, wherein a plurality of simplex documents are contained in a state where image faces thereof are faced upward, the means for feeding feeds the documents from the bottommost one, and the means for returning returns the document to a position above the uppermost one of the stacked documents in the recirculating document feeder.

* * * * *